US006685532B1

(12) United States Patent
McLean

(10) Patent No.: US 6,685,532 B1
(45) Date of Patent: Feb. 3, 2004

(54) PLUSH ASSEMBLY AND METHOD FOR STUFFING SAME

(76) Inventor: Gerald J. McLean, 9577 Crosley, Redford, MI (US) 48239

( * ) Notice: Subject to any disclaimer, the term of this patent is extended or adjusted under 35 U.S.C. 154(b) by 0 days.

(21) Appl. No.: 10/272,190

(22) Filed: Oct. 16, 2002

(51) Int. Cl.[7] ..... A63H 3/02
(52) U.S. Cl. ..... 446/369; 53/469
(58) Field of Search ..... 446/369, 385, 446/370, 371, 372; 53/469, 258, 390, 452; 24/432, 429, 415, 416, 417, 418, 419; 2/82, 80, 83

(56) References Cited

U.S. PATENT DOCUMENTS

| | | | | |
|---|---|---|---|---|
| 1,183,652 A | * | 5/1916 | Krich | |
| 1,219,881 A | | 3/1917 | Sundback | |
| 2,280,999 A | * | 4/1942 | Carlile | |
| 3,239,905 A | * | 3/1966 | Weiner | |
| 3,775,812 A | | 12/1973 | Carver, Jr. | |
| 4,031,723 A | | 6/1977 | Samhammer et al. | |
| 4,081,882 A | | 4/1978 | Toepelt et al. | |
| 4,116,148 A | | 9/1978 | Torrez | |
| 4,244,086 A | | 1/1981 | Gregg | |
| 4,287,646 A | * | 9/1981 | Kanzaka | 24/205.14 R |
| 4,563,159 A | | 1/1986 | Hills et al. | |
| 4,715,840 A | | 12/1987 | Swift | |
| 4,822,285 A | * | 4/1989 | Summerville | 434/272 |
| 4,829,638 A | * | 5/1989 | Ishii | 24/421 |
| 5,081,855 A | | 1/1992 | Terada et al. | |
| 5,090,938 A | * | 2/1992 | Reynolds | 446/369 |
| 5,878,467 A | * | 3/1999 | Yokota | 24/429 |
| 5,884,373 A | * | 3/1999 | Kawamura | 24/421 |
| 5,911,312 A | * | 6/1999 | Holyfield | 2/69 |
| 5,911,369 A | * | 6/1999 | Yamazaki | 24/429 |
| 6,048,248 A | | 4/2000 | Ritchey | |
| 6,109,196 A | * | 8/2000 | Silber | 112/475.08 |
| 6,325,695 B1 | | 12/2001 | Weiner | |
| 6,527,617 B1 | * | 3/2003 | Capozzi et al. | 446/369 |

* cited by examiner

*Primary Examiner*—Derris H. Banks
*Assistant Examiner*—Jamila Williams
(74) *Attorney, Agent, or Firm*—Clark Hill PLC

(57) ABSTRACT

A plush assembly is stuffed with filler material to form a stuffed product. The plush assembly includes a plush defining an exterior and an aperture for receiving the filler material therein. The aperture is opened and closed or sealed with a zipper. The zipper includes a slide that is movable therealong. The slide includes a lock extendable out from the slide that engages the zipper to lock the slide in a position along the zipper. A string is used to prevent the slide from being locked until the plush is filled and the aperture is closed. Then the string is removed by cutting it, maintaining the slide in a locked state.

3 Claims, 6 Drawing Sheets

PLUSH ASSEMBLY AND METHOD FOR STUFFING SAME

BACKGROUND ART

1. Field of the Invention

The invention relates to synthetic objects that are stuffed with a material. More particularly, the invention relates to plush assemblies used in the fabrication of the synthetic stuffed object.

2. Description of the Related Art

Stuffed synthetic products are used in several applications. One of these applications is stuffed toys. The stuffed products are fabricated using a plush, or carcass, that is stuffed with a compressible material. Oftentimes, the material is a fluffy, synthetic material so the plush feels soft and squeezable upon completing the assembly process. Examples of these stuffed products include, but are not limited to, teddy bears, stuffed animals, stuffed balls, blocks, baby rattles, squeak toys and the like, hereinafter referred to as "stuffed toys."

When assembling the stuffed toys, consideration must be taken for how the stuffed toys are to be packaged, delivered, and displayed. In a store situation, the stuffed toys may be stored in a back room until they are needed for display on a shelf or in the storefront displays. In the situation where a fair or carnival is using the stuffed toys as prizes, storage is much more difficult to come by. Therefore, the plushes are usually transported to the carnivals empty. The plushes are filled or stuffed based on the forecasted need for the following period of time before the carnival must move to its next location. Therefore, there needs to be a simple and effective way of stuffing the stuffed animals and sealing the plushes at the location where the stuffed toys are to be distributed.

Further to this end, there is a new market for stuffed toys, namely stuffed animals, where the purchaser purchases a stuffed animal at a retail outlet and stuffs the stuffed animal allowing the purchaser to feel as though she had created the stuffed animal. As with the carnival situation, there is a need in the retail outlet to allow a purchaser of a stuffed animal, who is inexperienced at stuffing plushes, to easily stuff a plush and seal it to create a stuffed animal.

U.S. Pat. No. 6,109,196 discloses a method of closing a plush toy after stuffing. In this reference, an aperture is loosely closed with a stitch or cross-stitch. A stuffing tool is inserted into the empty plush through the loosely stitched aperture to fill the plush with filler material. Once the plush is full, the tool is removed and the loose stitch is pulled tight to close the aperture. Once tightened, the thread creating the stitch is tied and the purchaser has a stuffed plush ready for accessories. This method is deficient in that it is cumbersome to insert a tool into the loosely stitched aperture when filling the plush. In addition, preparing the plush with the loose stitch requires intensive man hours, increasing the cost of the stuffed toy.

SUMMARY OF THE INVENTION

A plush assembly is stuffed with filler material to form a stuffed product. The plush assembly includes a plush defining an exterior and an aperture for receiving the filler material therein. The aperture includes two longitudinal sides and extends between an open end and a closed end. A strip of hooks and hollows is fixedly secured to each of the longitudinal sides between the open and closed ends. A slide is movable along the strips of hooks and hollows to form a zipper. The slide moves between the open end and the closed end to engage and disengage the strips of hooks and hollows to open and close the aperture. The slide includes a lock to engage the strips of hooks and hollows to lock the slide in a position along the strips of hooks and hollows.

BRIEF DESCRIPTION OF THE DRAWINGS

Advantages of the invention will be readily appreciated as the same becomes better understood by reference to the following detailed description when considered in connection with the accompanying drawings, wherein.

DETAILED DESCRIPTION OF THE PREFERRED EMBODIMENT

Figure 1:
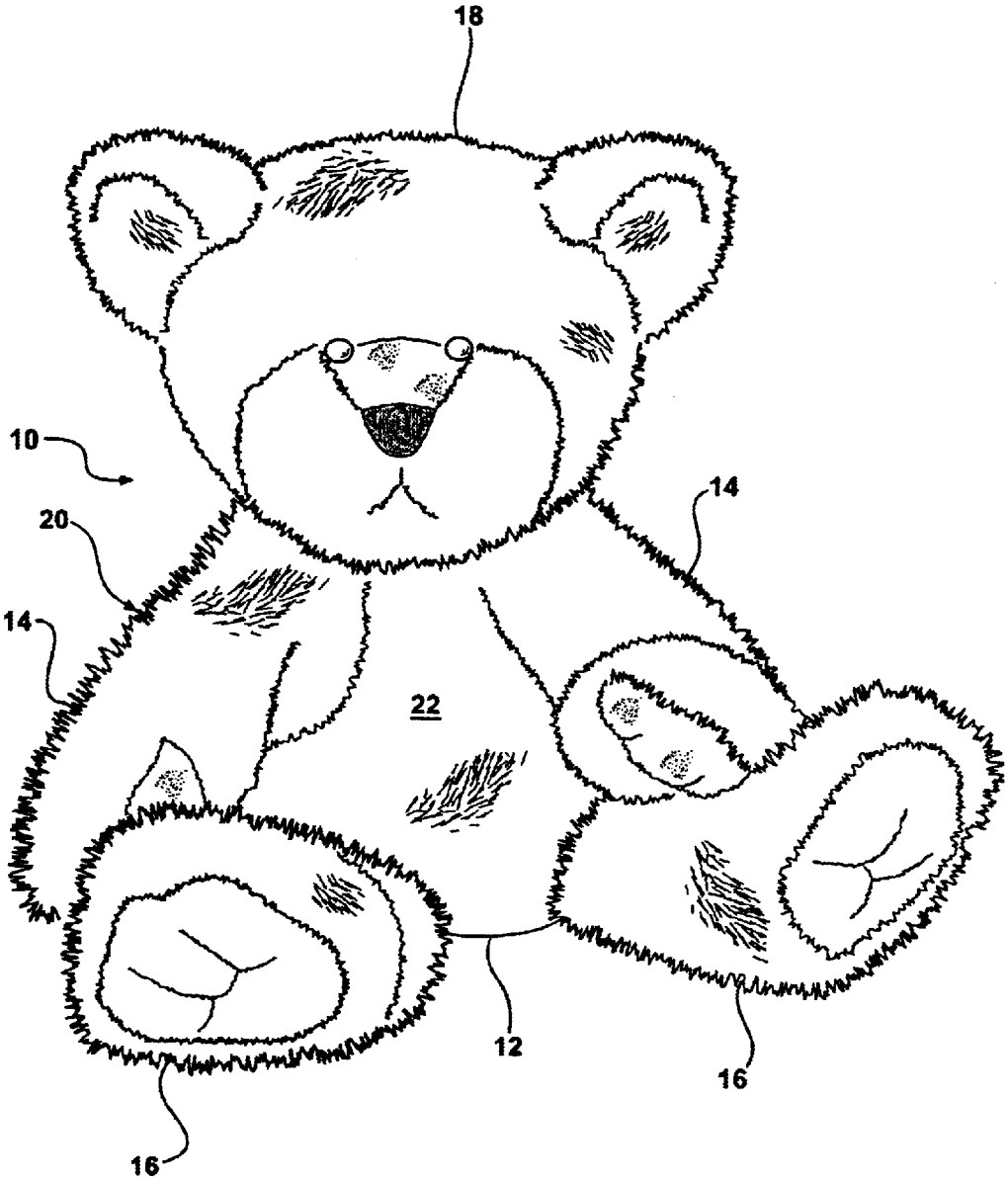
FIG. 1 is a perspective view of a stuffed toy incorporating one embodiment of the invention.
Figure 2:
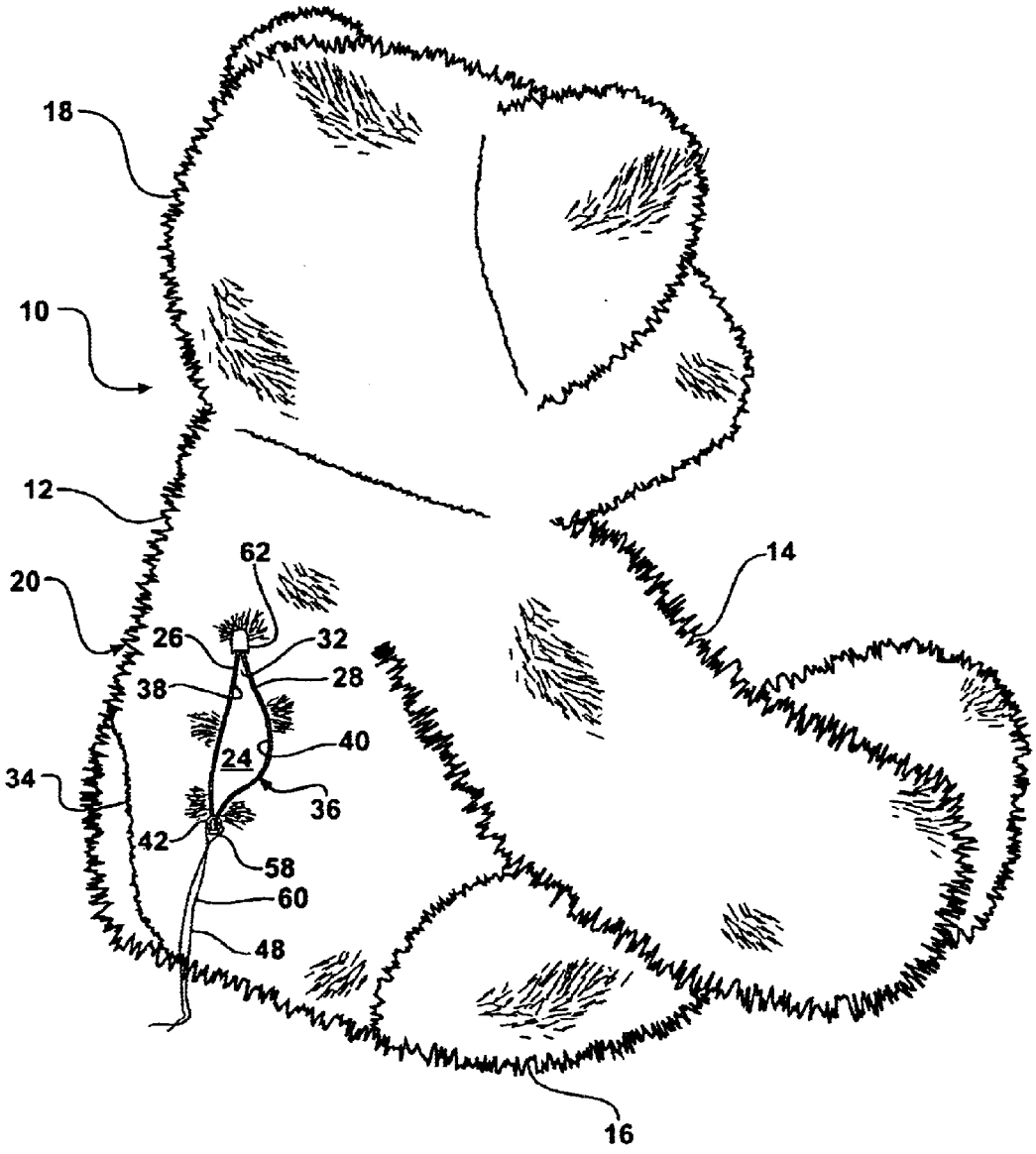
FIG. 2 is a side perspective view of a stuffed toy with an open aperture and incorporating one embodiment of the invention.
Figure 3:
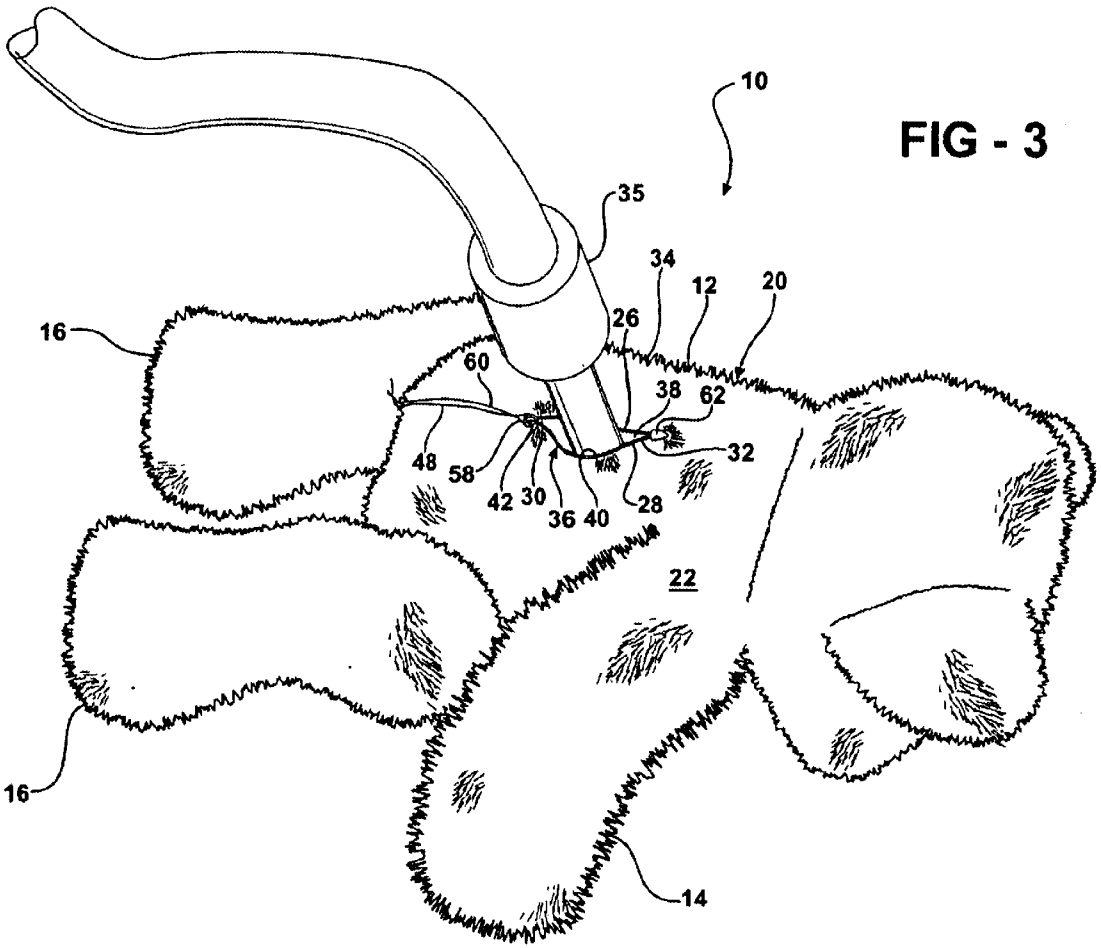
FIG. 3 is a perspective view of a stuffed toy being filled with a filler material.
Figure 4:
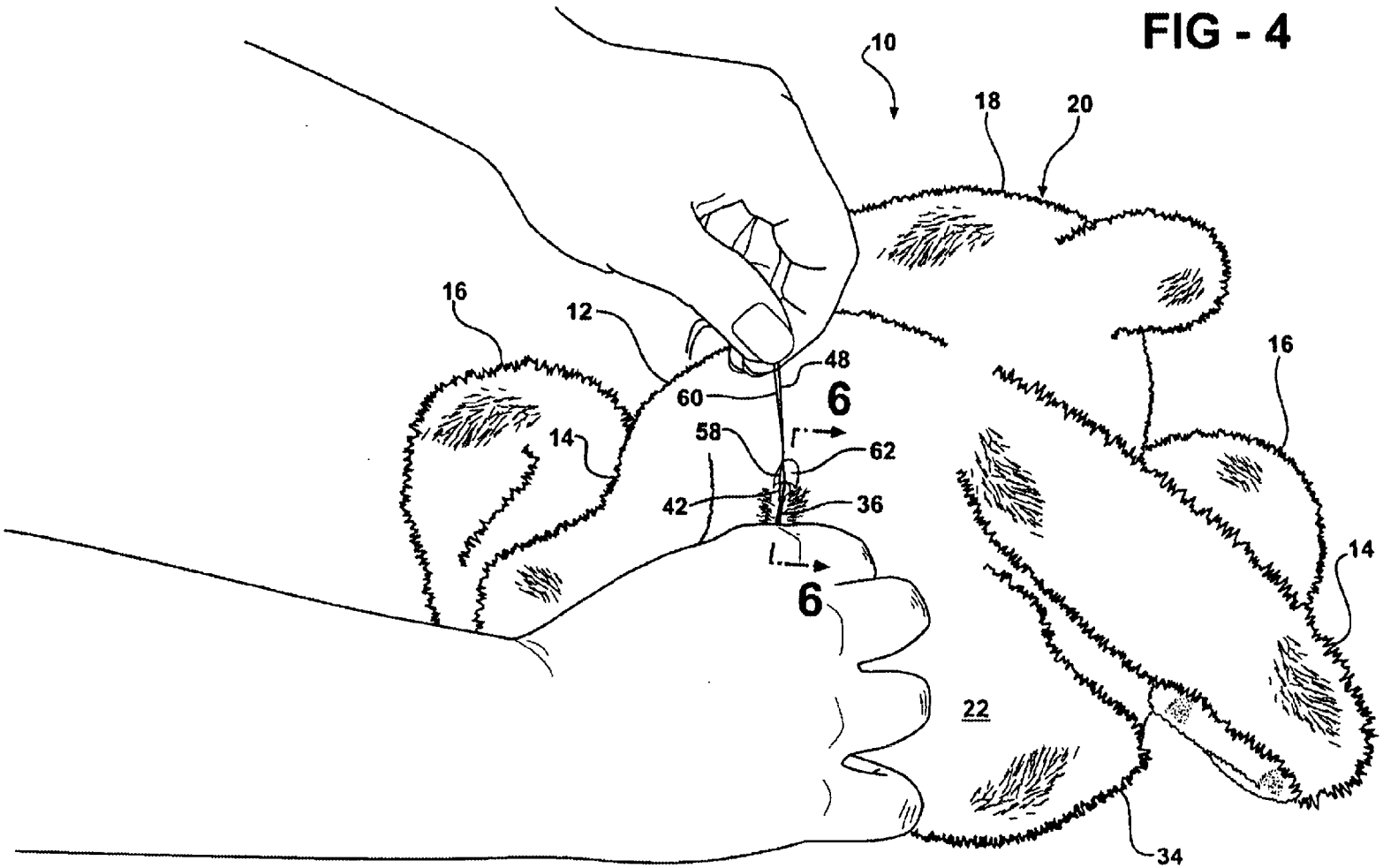
FIG. 4 is a perspective view of an operator using one embodiment of the invention to close the aperture of the stuffed toy.
Figure 5:
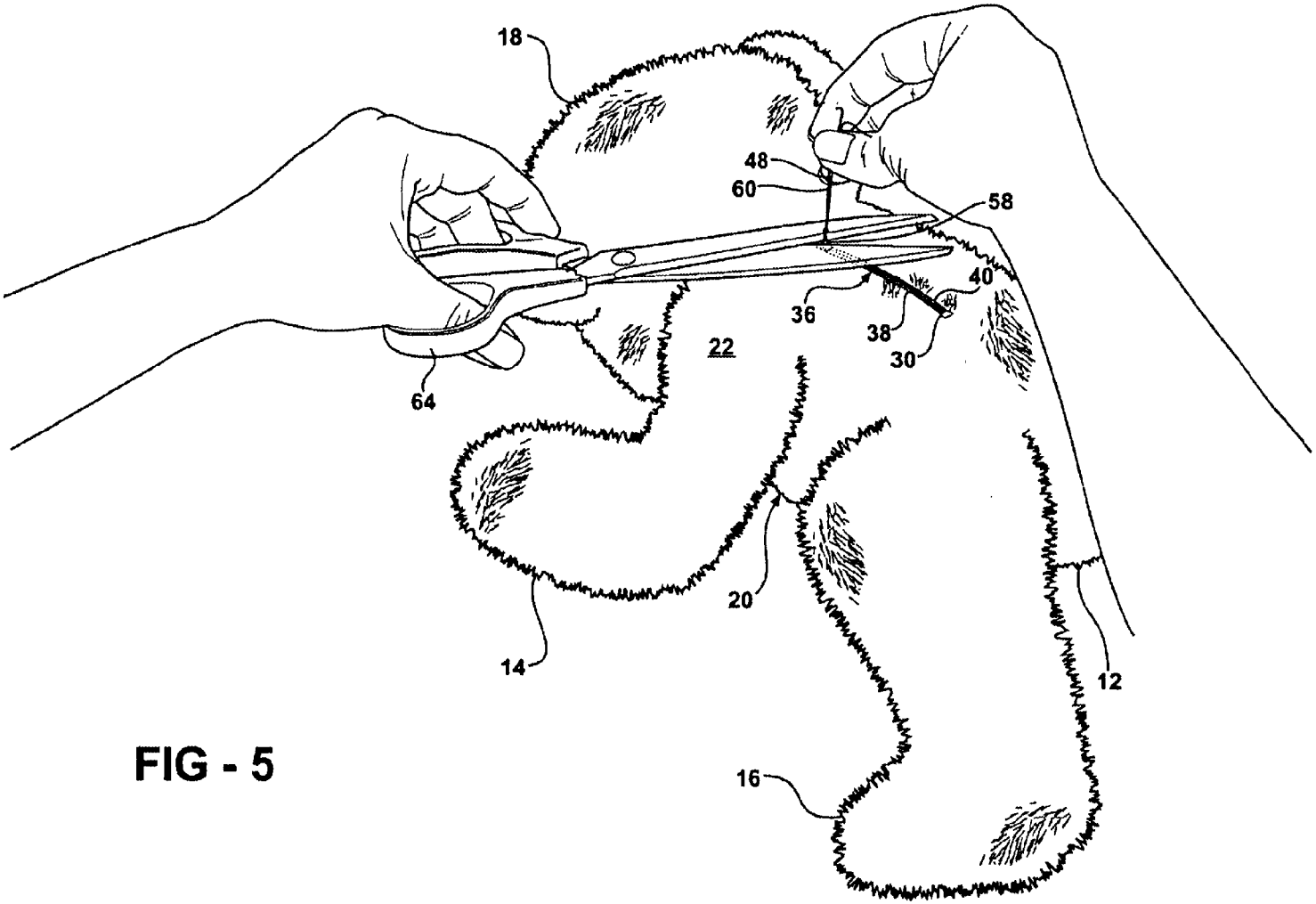
FIG. 5 is a perspective view of an operator removing a portion of one embodiment of the invention.

A plush assembly is generally indicated at 10. In the Figures, the plush assembly 10 is in the configuration of a stuffed bear, commonly referred to as a teddy bear. The plush assembly 10 includes a torso 12, arms 14, legs 16 and a head 18. While the plush assembly 10 is in the configuration of a bear, it should be appreciated by those skilled in the art that the plush assembly 10 may be designed to represent any other animal configuration. In addition, the plush assembly 10 can be configured to resemble any type of toy. Such examples of toys may include, but are not limited to, animal configurations, footballs, basketballs, soccer balls, and the like.

Continuing with the example of the stuffed bear, the plush assembly 10 includes a plush, generally shown at 20, used to create an exterior 22 for the plush assembly 10. The torso 12, arms 14, legs 16 and head 18 may be created from a single piece of material to create the exterior 22 or, in the alternative, the plush 20 may be fabricated from a plurality of pieces of fabric sewn together to create the exterior 22.

In the preferred embodiment, the plush 20 includes an aperture 24 providing access to the interior of the plush 20. The aperture 24 defines two longitudinal sides 26, 28, an open end 30 and a closed end 32. The aperture 24 is shown on a back panel 34 of the plush 20. It should be appreciated by those skilled in the art that the aperture 24 can extend along any portion of the exterior 22 of the plush 20. The aperture 24 is used to allow a tool 35 to have filler materials blown into the plush to stuff the plush assembly 10. The aperture 24 may also be used to provide access to the interior of the plush assembly 10 to insert other items in addition to the filler material. These items might include items that are symbolic, e.g., a heart.

The plush assembly 10 includes a zipper, generally indicated at 36. The zipper 36 includes two strips of hooks and hollows 38, 40. Each strip of hooks and hollows 38, 40 is fixedly secured to each of the longitudinal sides 26, 28. Each strip of hooks and hollows 38, 40 extends entirely between the open end 30 and the closed end 32 of the aperture 24. The strips of hooks and hollows 38, 40 are sewn to the longitudinal sides 26, 28 of the aperture 24 as is known in the art.

The zipper 36 also includes a slide 42 that rides along the strips of hooks and hollows 38, 40. The slide 42 moves between the open end 30 and the closed end 32 of the aperture 24. As is known in the art, the slide 42 incorporates a wedge and two ramps (neither shown) to force the hooks into the hollows of the opposing strip to secure the two strips of hooks and hollows 38, 40 together. In the reverse direction, the wedge forces the hooks out of the hollows allowing the two strips of hooks and hollows 38, 40 to separate.

Figure 6:
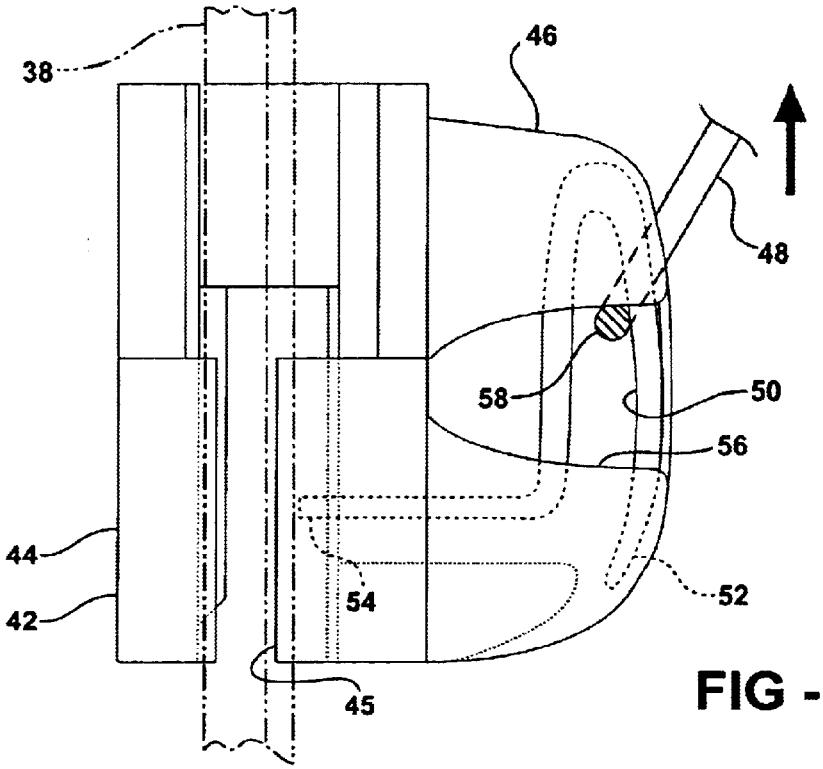
FIG. 6 is a diagrammatic side view taken along lines 6—6 of FIG. 4.
Figure 7:
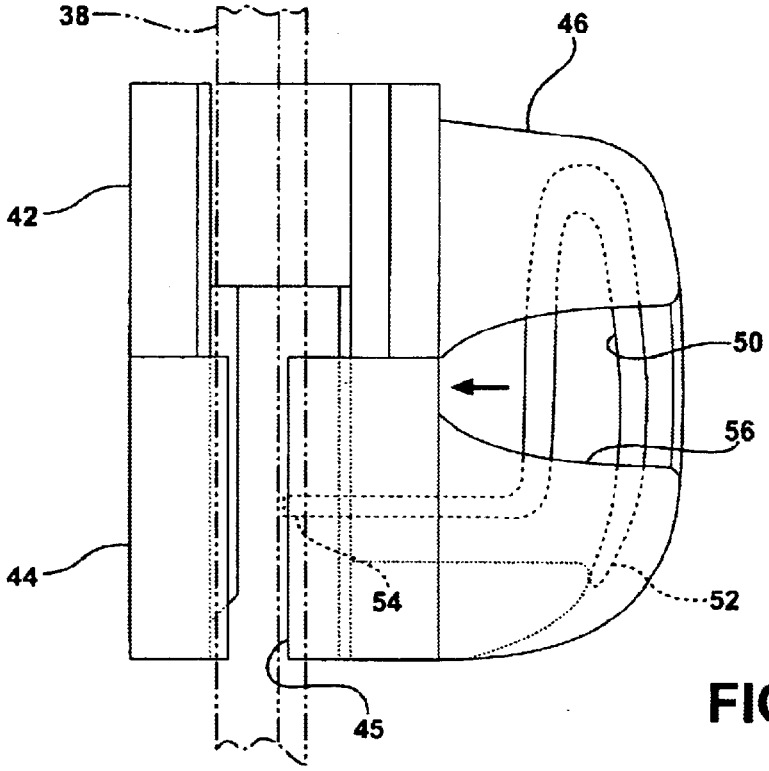
FIG. 7 is a diagrammatic side view of a slide of a zipper with the releasing device removed therefrom.

Referring to FIGS. 6 and 7, the slide 42 is shown in greater detail. The slide 42 includes a base 44 that includes a channel 45 through which the strips of hooks and hollows 38, 40 travel. The slide 42 includes a locking tower 46 that extends out from the base 44. A releasing device 48 extends through the locking tower 46, as will be discussed in greater detail subsequently.

The releasing device 48 is used to release a lock 50. The lock 50 inhibits movement of the slide 42 along the strips of hooks and hollows 38, 40. The lock 50 extends between a hook end 52 and a strip engaging end 54. The strip engaging end 54 engages the strips of hooks and hollows 38, 40 to prevent the slide 42 from moving therealong. The hook end 52 extends through a curved path and, together with the locking tower 46, defines a releasing aperture 56 through which the releasing device 48 extends.

The releasing device 48 selectively unlocks the lock 50 to allow the slide 42 to move along the strips of hooks and hollows 38, 40. The releasing device 48 is removable from the slide 42. More specifically, the releasing device 48 is designed to be removed once the plush 20 has been filled with filler material and the slide 42 has moved to a position adjacent the closed end 32 of the aperture 24. This prevents the slide 42 of the zipper 36 from being inadvertently moved away from the closed end 32 allowing filler material to be inappropriately removed from the interior of the plush 20.

In the preferred embodiment, the releasing device 48 is a pull string having a loop portion 58 and a pull portion 60. The loop portion 58 extends around the hook end 52 of the lock 50. The pull portion 60 extends out and away from the plush 20 allowing the user thereof to grab a hold of the pull portion 60 to move the slide 42 between the open end 30 and the closed end 32 of the aperture 24.

The plush assembly also includes a slide cover 62. The slide cover is fixedly secured to the plush 20 adjacent the closed end 32 of the aperture 24. The slide cover 62 covers the slide 42 when the slide 42 is disposed adjacent the closed end 32 of the aperture 24. The slide 42 slides under and is covered by the slide cover 62 removing the slide 42 from view after filler material has been moved into the interior of the plush 20 and the aperture 24 is closed. The slide cover 62 is fabricated from an elastic material to provide additional restraint of the slide 42 at the closed end 32 of the aperture 24.

In operation, the slide 42 is moved to the open end 32 of the aperture 24. The plush 20, of which at least a portion is hollow, is then filled with the filler material to create a stuffed plush 20. At this time, additional items like that which was referenced above may also be inserted into the plush 20. Once filled, the slide 42 is moved to the closed end 32 of the aperture 24 to close the aperture 24 to prevent the filler material from falling out from the interior of the plush 20 through the aperture 24. The slide 42 is moved by grasping the pull portion 60 of the releasing device 48 and applying a force to the releasing device 48 in the direction of the closed end 32.

Once the slide 42 is in a position adjacent the closed end 32, the releasing device 48 is removed from the plush assembly 10 to prevent the lock 50 from unlocking. In the preferred embodiment, the removal of the releasing device 48 includes the step of cutting the loop portion 58 of the releasing device 48 with a pair of scissors 64 prior to the step of removing the releasing device 48 from the plush assembly 10. In the embodiment shown, the releasing device 48 is a pull string. When the loop portion 58 of the pull string 48 is cut, it may be removed from the slide 42. This allows the lock 50 to move (laterally in the figures shown) allowing the strip engaging end 54 to engage the strips of hooks and hollows 38, 40. Once the releasing device 48 is removed from the slide 42, the slide 42 may be covered by forcing the slide cover 62 over the slide 42.

Many modifications and variations of the invention are possible in light of the above teachings. Therefore, within the scope of the appended claims, the invention may be practiced other than as specifically described.

I claim:

1. A plush assembly to be stuffed with filler material to form a stuffed toy, said plush assembly comprising:

a plush defining an exterior, said plush including an aperture for receiving the filler material therein, said aperture including two longitudinal sides, an open end and a closed end;

a strip of hooks and hollows fixedly secured to each of said longitudinal sides between said open and closed ends;

a slide movable along said strips of hooks and hollows between said open end and said closed end to engage and disengage said strips of hooks and hollows to open and close said aperture, said slide including a lock to engage said strips of hooks and hollows to lock said slide in a position along said strips of hooks and hollows; and a pull string engaging said lock to selectively unlock said lock to allow said slide to move along said strips of hooks and hollows, wherein said pull string is removed from said slide after said plush is filled with the filler to permanently prevent said aperture from opening by keeping said slide adjacent said closed end thereof.

2. A method for stuffing a plush assembly with filler material wherein said plush assembly includes a hollow plush, an aperture defining two longitudinal sides, an open end and a closed end, and a zipper defining two strips of hooks and hollows extending along the two longitudinal sides of the aperture, a slide movable along the strips of hooks and hollows, and a lock with a releasing device, the method comprising the steps of:

moving the slide to the open end of the aperture;

filling the hollow plush with the filler material to create a stuffed plush;

moving the slide to the closed end of the aperture to close the aperture to prevent the filler material from falling through the aperture;

engaging the lock to lock the slide in a location disposed adjacent the closed end of the aperture;

cutting the releasing device; and removing the releasing device from the plush assembly to prevent the lock from unlocking.

3. A method as set forth in claim 2 including the step of covering the slide after the step of removing the releasing device to hide the slide from view.

* * * * *